United States Patent [19]

Ramey

[11] Patent Number: 4,573,415

[45] Date of Patent: Mar. 4, 1986

[54] STAND WITH SPRING LOCK LEGS

[75] Inventor: Edwin O. Ramey, Fort Lauderdale, Fla.

[73] Assignee: Atlas Metal Industries, Inc., Miami, Fla.

[21] Appl. No.: 629,187

[22] Filed: Jul. 6, 1984

[51] Int. Cl.[4] ..... A47B 3/00

[52] U.S. Cl. ..... 108/129; 108/132; 248/188

[58] Field of Search ..... 108/132, 131, 133, 129, 108/156; 248/188

[56] References Cited

U.S. PATENT DOCUMENTS

| | | | |
|---|---|---|---|
| 696,625 | 4/1902 | Churchman | 108/131 X |
| 1,966,344 | 7/1934 | Hallowell et al. | 108/131 |
| 2,531,259 | 11/1950 | Cudini | 108/133 |
| 3,126,189 | 3/1964 | Van Syoc, Sr. | 248/188 |
| 3,845,728 | 11/1974 | Piretti | 108/131 |
| 3,960,352 | 6/1976 | Plattner et al. | 248/188 |

FOREIGN PATENT DOCUMENTS

| | | | |
|---|---|---|---|
| 250194 | 3/1964 | Australia | 108/132 |
| 2324921 | 12/1974 | Fed. Rep. of Germany | 108/132 |

*Primary Examiner*—Francis K. Zugel

*Attorney, Agent, or Firm*—Harvey B. Jacobson

[57] ABSTRACT

A stand, table or other supporting structure having one or more supporting leg assemblies connected thereto in such a manner that the leg assemblies can be collapsed into a compact condition to facilitate storage, transportation and handling of the stand, table or other supporting structure. The leg assemblies are retained in their operative position substantially perpendicular to and rigid with respect to the stand to provide a stable support for the stand and for any item or items placed thereon. The leg assemblies are retained releasably in their operative position by a manually operated spring lock device that is provided with a camming feature which enables automatic locking of the leg assembly when oriented into operative position and maintaining a continuous upward bias on the leg assembly for maintaining the rigid perpendicularity of the leg assembly in relation to the stand. In one embodiment of the invention, the leg assembly is hingedly connected to the stand for folding movement into generally underlying parallel relation to the stand. In another embodiment of the invention, the leg assembly is releasable from the stand for movement to a collapsed or compact condition either alongside the underside of the stand or in a separate area which enables the leg assembly of the present invention to be utilized with a stand, table or other supporting structure which has a lateral dimension less than the length of the leg assembly.

11 Claims, 14 Drawing Figures

STAND WITH SPRING LOCK LEGS

BACKGROUND OF THE INVENTION

1. Field of the Invention

The present invention generally relates to a stand, table or other supporting structure having a plurality of legs or leg assemblies connected thereto for securely, stably and rigidly supporting the stand, table or other supporting structure in elevated relation with the leg or leg assembly being releasably retained in perpendicular relation to the stand, table or supporting structure so that the legs or leg assemblies can be moved to a stored position either by folding or hinging the legs or leg assemblies inwardly or by detaching the legs or leg assemblies in relation to the stand, table or supporting structure with the legs or leg assemblies being retained in operative position by a spring lock and cam assembly which provides a positive, secure and stable connection between the stand, table or supporting structure and the legs or leg assemblies.

2. Description of the Prior Art

Stands, tables and similar supporting structures have been provided for many purposes and in many instances, such structures are provided with collapsible supporting legs. Conventionally, such structures include pivotally attached legs with a folding brace interconnecting the leg and the stand structure in spaced relation to the pivot axis to enable the legs to be pivoted from a generally vertical position to a generally horizontal position underlying the stand so that the stand can be stored, transported and handled in a more efficient manner. In addition, various types of pivotal and other connections are provided to enable the legs to move from an operative position to a collapsed condition with the following U.S. patents being relevant to this field of endeavor.

| | |
|---|---|
| 1,052,329 | 2/4/13 |
| 2,221,932 | 11/19/40 |
| 3,096,732 | 7/9/63 |
| 3,166,029 | 1/19/65 |
| 3,993,004 | 11/23/76 |
| 4,079,679 | 3/21/78 |

SUMMARY OF THE INVENTION

An object of the present invention is to provide a stand or equivalent supporting structure having a plurality of legs attached thereto in a manner and by using a structure that enables the legs to be moved from an operative position oriented generally vertically to a collapsed position that in one embodiment is a position with the legs folded into underlying relation to the stand and in another embodiment the legs are separated from the stand for positioning alongside the undersurface or any other portion of the stand or in any other desired location.

Another object of the invention is to provide a stand and legs in accordance with the preceding object in which the legs are releasably secured in a stable operative relation to the stand by a spring lock mechanism that is manually released but automatically engaged when the legs are oriented in operative position with the spring lock mechanism including a camming feature to continuously bias the legs upwardly into contacting and stable relation to the stand.

A further object of the invention is to provide a stand with legs as set forth in the preceding object in which the locking mechanism also includes a cam surface on the legs which automatically moves the spring locking mechanism into locking position as the legs are moved toward their operative position.

Still another object of the invention is to provide a stand with spring locked legs in which the stand is provided with a bracket on the undersurface thereof and the leg is provided with a bracket at the upper end thereof with a hinge axis or detachable engaging mechanism interconnecting the brackets in offset relation to the center of the legs with the spring lock and cam structure being offset to the opposite side of the brackets and legs.

A still further object of the invention is to provide a stand, table or similar supporting structure with legs which are spring loaded in operative position which structure is relatively easy to operate, dependable and long lasting and provides a stable stand, table or other supporting structure.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
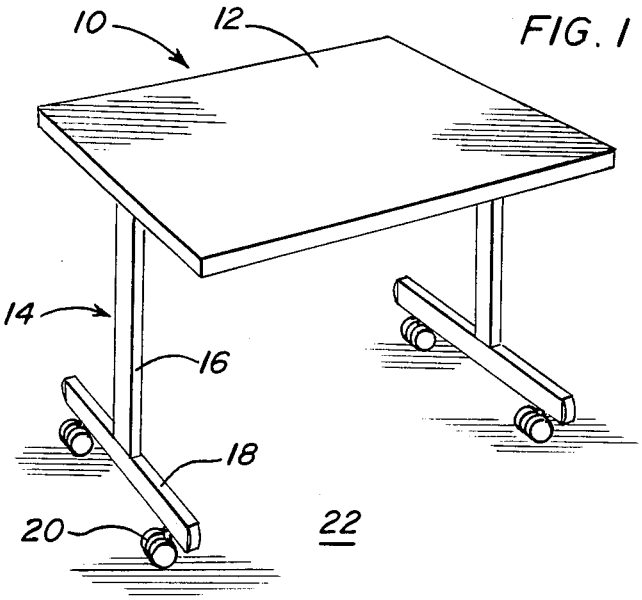
FIG. 1 is a perspective view of the stand, table or supporting structure of the present invention.
Figure 3A:
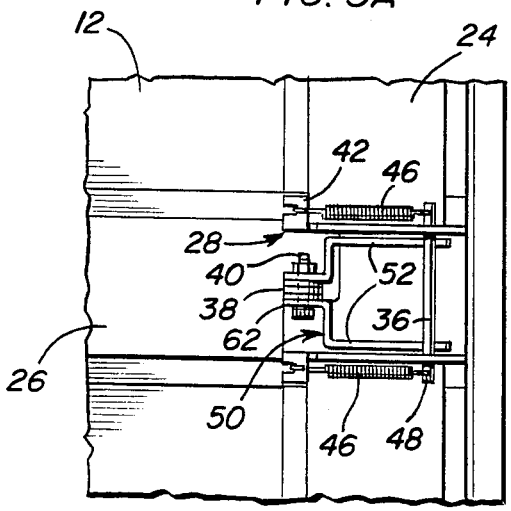
FIG. 3A is an enlarged fragmental bottom elevational view similar to FIG. 3 but with the leg omitted.

Referring now specifically to FIGS. 1–7, the stand and spring locked legs of the present invention is generally designated by the numeral 10 and includes a generally rectangular supporting panel 12 which may take various forms and configurations and may be considered a stand, table, supporting frame or other supporting structure in which there is generally a horizontally disposed supporting surface as illustrated with the structure of the stand itself being optional and including various materials, finishes and the like. As illustrated, the opposite ends of the stand 10 are supported by a leg 14 with the configuration of the legs as illustrated being a hollow tubular member 16 although other configurations and structures may be used with the lower end of the hollow tubular member including a transverse hollow tubular member 18 paralleling the supporting surface 12 and including casters or rollers 20 on the bottom of each end thereof for supporting the stand 10 movably from a suitable supporting floor surface 22 or the like with it being pointed out that the specific configuration of the leg 14 may vary with the dimensional characteristics and relationships of the components also being variable as required.

Figure 2:
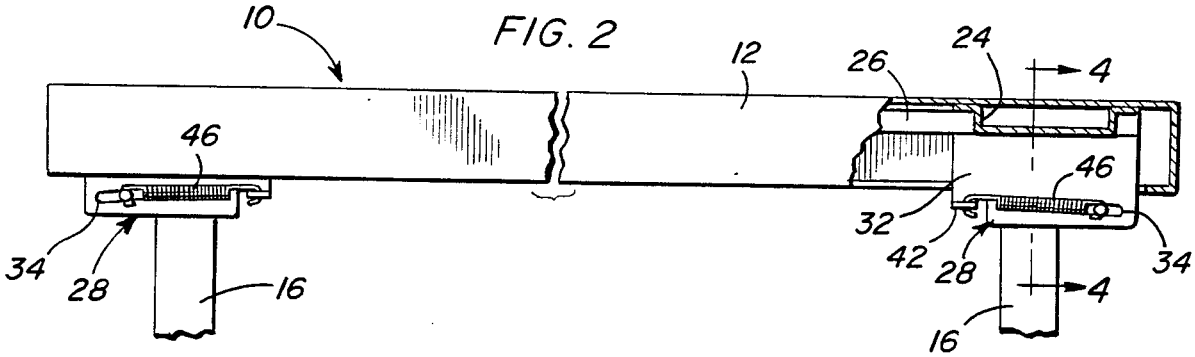
FIG. 2 is a side elevational view thereof with a portion of the stand broken away to illustrate the structure of the present invention.
Figure 3:
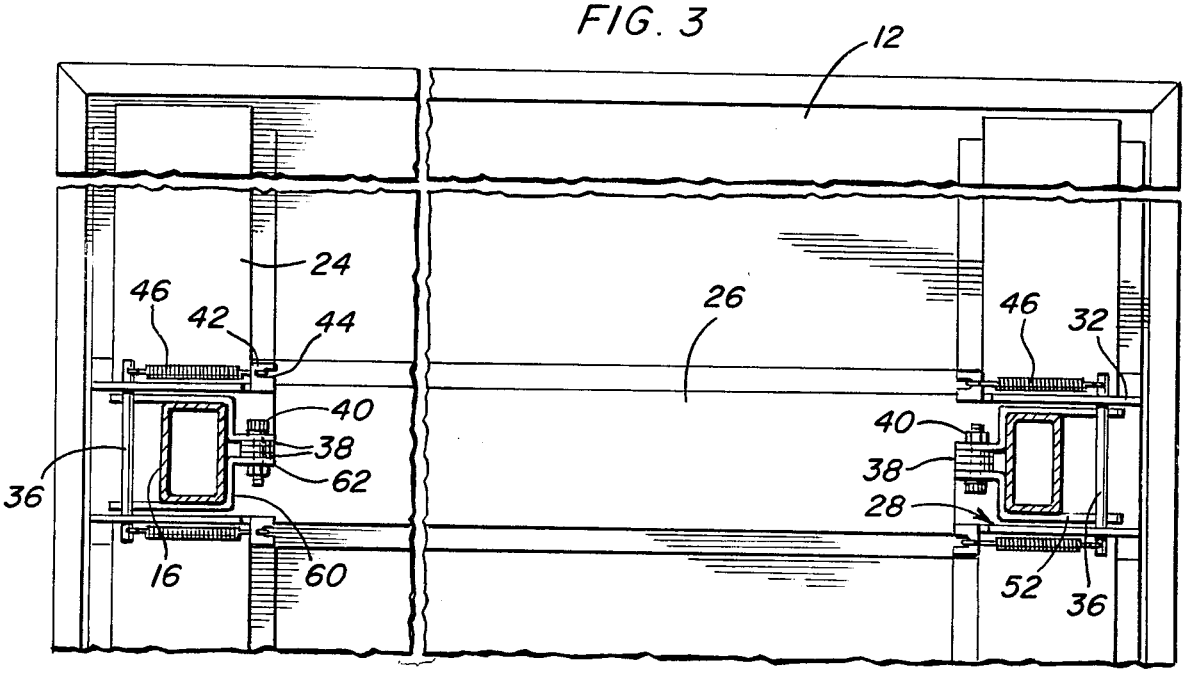
FIG. 3 is a bottom plan view of the stand with the legs illustrated in section.
Figure 4:
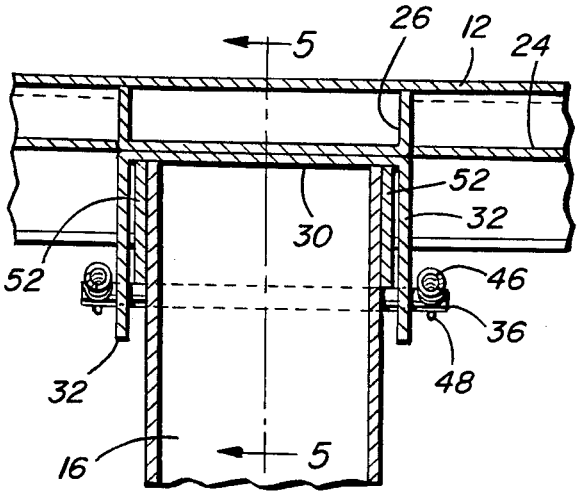
FIG. 4 is a detailed sectional view taken substantially upon a plane passing along section line 4—4 on FIG. 2 illustrating the structural details of the connection between the stand and legs.
Figure 5:
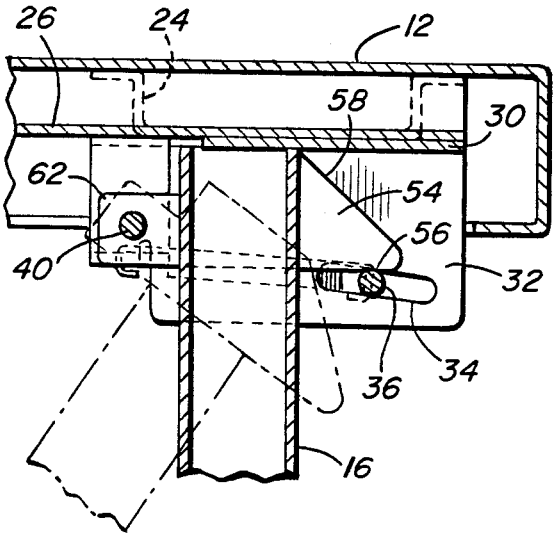
FIG. 5 is a detailed sectional view taken substantially upon a plane passing along section line 5—5 on FIG. 4 illustrating further structural details of the connection between the stand and legs illustrating the pivot axis, the cam structure and spring lock mechanism.

The connection between the supporting panel or surface 12 and the tubular leg 16 is illustrated in more detail in FIGS. 3–5 with this structure including a transverse channel-shaped frame member 24 underlying and forming part of the supporting panel 12 as illustrated in FIGS. 2 and 3 with the flanges on the channel 24 being secured in any suitable manner. A similar channel 26 extends perpendicularly to the channel 24 with the channels 26 and 24 intersecting at the end portions of the supporting panel 12. Attached to the end portion of the channel 26 that is received between the ends of the channel 24 is an inverted U-shaped bracket 28 having a bight portion 30 secured to the channel 26 in any suitable manner and depending parallel lugs or legs 32 oriented in parallel spaced relation with the width of the bracket 28 being generally equal to the width of the channel 26 as illustrated in FIG. 4. Each of the lugs 32 is provided with an elongated slots 34 which terminates adjacent the outer edge of the lugs 32 and inclines upwardly and inwardly as illustrated in FIG. 5 for slidably receiving an elongated rod or bar 36 which is preferably cylindrical in construction and having end portions which project beyond the lugs 32 as illustrated in FIG. 4. The bight portion 30 of the bracket 28 includes downwardly struck lugs 38 which receive a pivot bolt 40 for a purpose set forth hereinafter. The bottom inner edge of the lugs 32 have outwardly struck tabs 42 having an inwardly extending notch 44 therein with a tension coil spring 46 having one end hooked into the notch 48 and the other end extending into and through an aperture 48 in the end of the rod 36 as illustrated in several figures of the drawings so that the rod 36 will be spring-biased inwardly and upwardly in the slot 34 thus providing a spring locking mechanism for retaining the tubular leg 16 in vertical and stable orientation in relation to the supporting panel 12.

Figure 6:
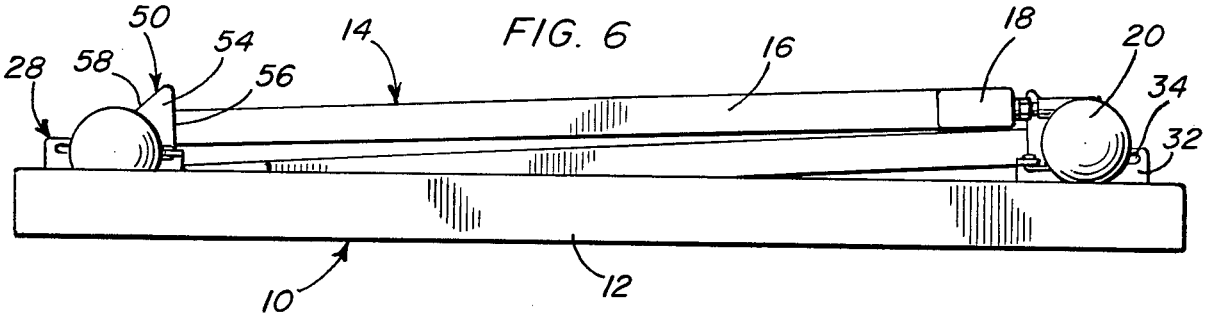
FIG. 6 is an elevational view of the stand in inverted position with the legs folded into a compact stored condition.
Figure 7:
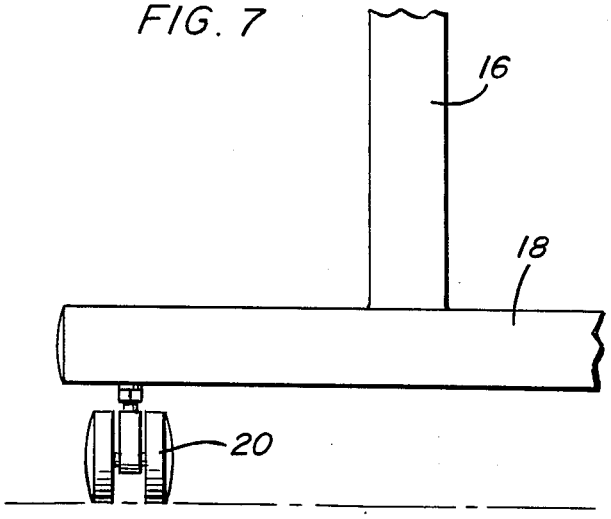
FIG. 7 is a fragmental elevational view of the lower end portion of one of the legs.
Figure 8:
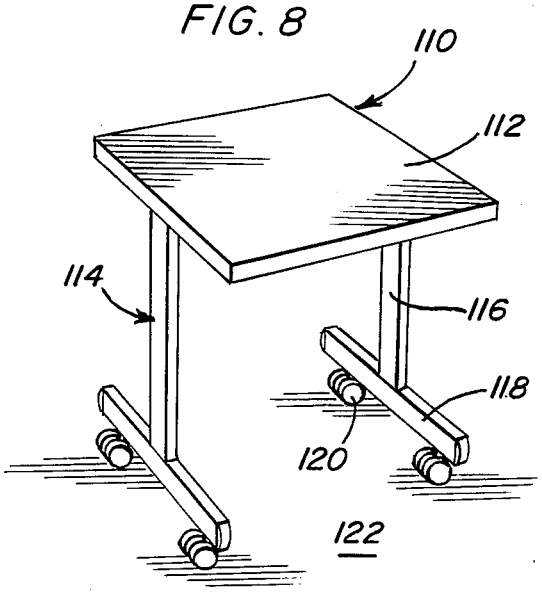
FIG. 8 is a perspective view of another embodiment of the stand in which the stand has a length less than the height of the legs.
Figure 9:
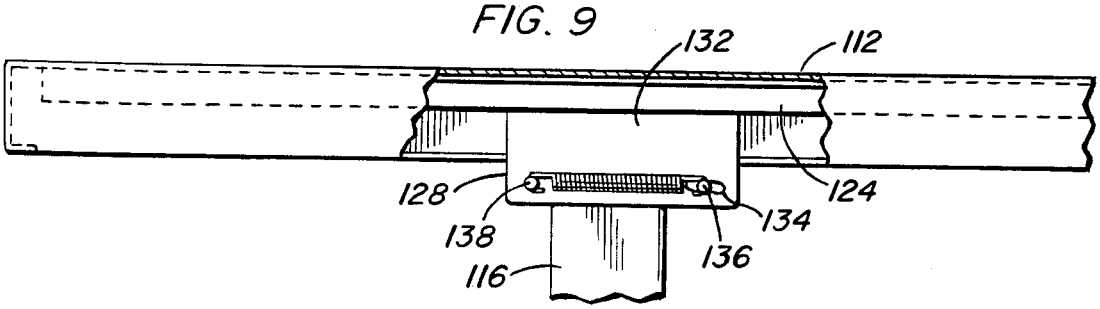
FIG. 9 is a side elevational view of the stand and leg of FIG. 8 illustrating the connection therebetween.
Figure 10:
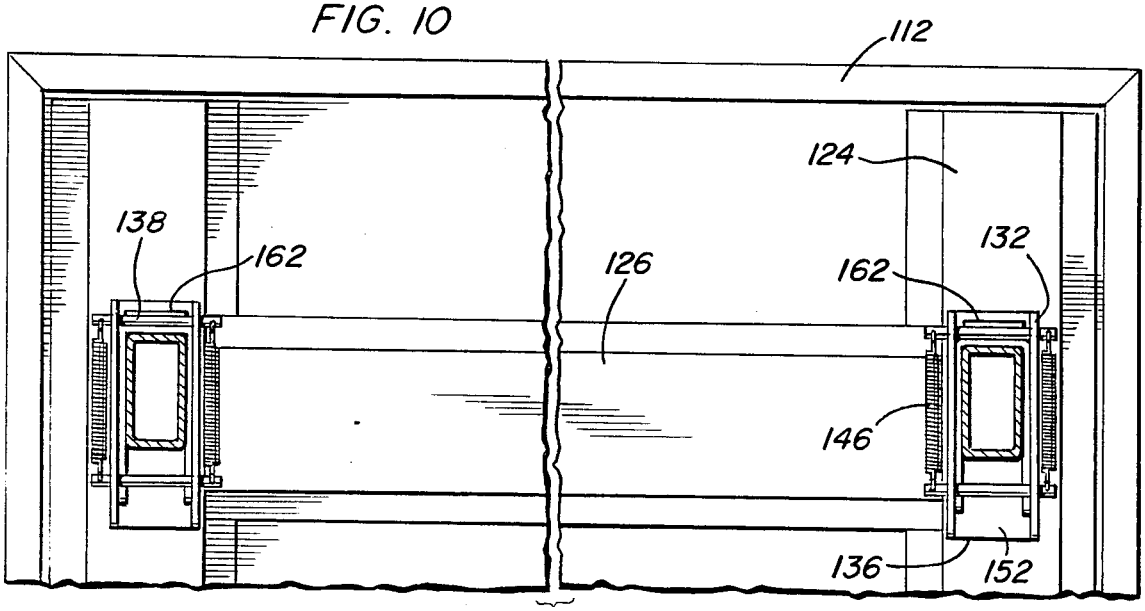
FIG. 10 is a bottom plan view with the legs in section illustrating further structural details of this embodiment of the invention.

The upper end of the tubular leg 16 is provided with a bracket 50 rigidly secured thereto and including a pair of side plates 52 rigidly attached to the tubular member 16 in any suitable manner with one end of the plates 52 extending outwardly beyond the tubular leg member 16 as indicated by numeral 54 with the lower edge of the extending member 54 being substantially straight as indicated by numeral 56 and the upper edge thereof being upwardly and inwardly inclined as indicated by numeral 58 so that the extending portion or tab 54 forms a camming arrangement when associated with the rod 36. The inner ends of the plates 52 are inturned at 60 and then extend inwardly at 62 for alignment with the lugs 38 which are received therebetween with the pivot bolt 40 thus pivotally securing the bracket 50 and thus the tubular leg member 16 to the bracket 28 and thus the supporting panel 14. As illustratedin FIG. 5, the top edge of the tubular leg member 16 coincides with the top edge of the plates 52 with the lugs 62 being spaced downwardly from the top edge thereof. With this construction, the upper ends of the tubular member 16 and the plates 52 abuttingly engage the undersurface of the bight portion 30 of the bracket 28 when in operative position as illustrated in FIGS. 4 and 5. In this orientation, the rod 36 is underlying and engaging the bottom edge 56 of the extending tabs 54 thereby biasing the tubular leg member 16 and the upper edges of the plates 52 upwardly into stable contacting relation with the undersurface of the bight portion 30 of the bracket 28. When it is desired to fold the leg 14 inwardly, it is only necessary to manually grasp the central portion of the rod 36 and pull it outwardly against the tension of the springs 46 until the tip end of the projecting tabs 54 can clear the rod 36 and pivot inwardly as illustrated in broken line in FIG. 5 so that the legs 14 can be stored in a compact position in underlying relation to the supporting panel 12 as illustrated in FIG. 6. When the leg 14 is moved to its operative position, it is only necessary to swing the leg 14 upwardly from the position illustrated in FIG. 6 towards perpendicular relationship to the supporting panel with the cam surface 58 engaging and automatically moving the rod 36 outwardly so that the rounded tip end of the tabs 54 can pass inwardly of the rod 36 at which time the tension of the springs 46 will snap the rod 36 inwardly in the slot 34 thus securely locking the leg 14 in perpendicular relation to the supporting panel 12 due to the upward inclination of the slots 34 and the horizontal orientation of the lower edge 56 of the projecting tabs 54 and the flat and flush engagement of the upper end of the tubular member 16 and the plates 52 with the bight portion 30 of the bracket 28 that is rigidly affixed to the supporting panel 12.

Thus, with this construction, the legs 14 at each end of the supporting panel can be quickly and easily collapsed into stored position with the supporting panel 12 preferably being inverted when this is done and likewise, it is more simple to move the legs form their horizontal stored position as illustrated in FIG. 6 to their operative vertical position when the stand, table or supporting structure 10 is oriented in inverted position. The legs 14 are securely and stably locked in their operative position and yet are easily and quickly moved to their collapsed position with the locking mechanism defined by the brackets, pivot bolt, cam slots and locking rod providing a stable and secure connection between the legs 14 and the supporting panel 12.

Figure 11:
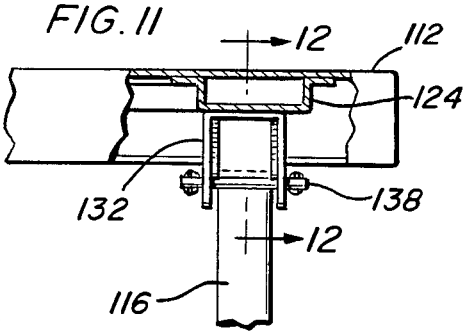
FIG. 11 is a fragmental sectional view of the stand and leg illustrating the connection therebetween.
Figure 12:
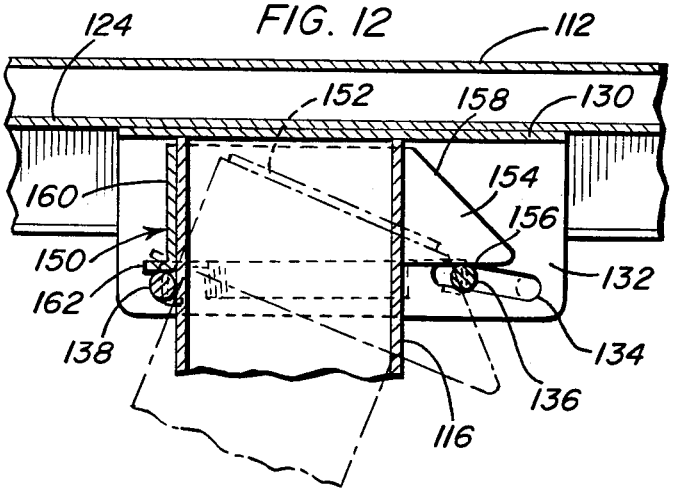
FIG. 12 is a detailed sectional view taken substantially upon a plane passing along section line 12—12 on FIG. 11 illustrating further structural details of the connection between the stand and leg.

FIGS. 8–13 disclose another embodiment of the invention including a stand 110 with a supporting panel 112 and legs 114 in which the length of the supporting panel 112 is less than the vertical dimension of the legs 114 so that they cannot be folded into overlapping relation in the same manner as the structure illustrated in FIGS. 1–7. In this embodiment of the invention, the legs 114 are detachably connected to the supporting panel 112 but otherwise the structure of the legs 114 is the same inasmuch as each leg 114 includes a tubular leg member 116 and a transverse tubular bottom member 118 having casters or supporting wheels 120 at each end thereof for engagement with a supporting surface 122. In this construction, the supporting panel 112 includes the same type of channels 124 and 126 thereunder with a mounting bracket 128 being attached to the channel 124 where it intersects with channel 126 with the bracket 128 including a bight portion 130 and depending lugs or flanges 132 each of which is provided with an upwardly and inclined slot 134 adjacent the outer edge thereof. The slots 134 receive an elongated locking rod or bar 136 for sliding movement therein with the ends of the rod or bar projecting beyond the lugs 132 as illustrated in FIG. 11. The inner ends of the lugs or flanges 132 are interconnected by a transverse rod or bar 138 that is rigidly affixed to the lower inner corner portions of the lugs 132 and extend outwardly therefrom generally in parallel relation to the rod 136 as illustrated in FIGS. 11 and 12. Tension coil springs 146 have their hooked ends engaged with the outer end portions of the rods 136 and 138 respectively to bias the rods 136 inwardly in relation to the slots 134.

Figure 13:
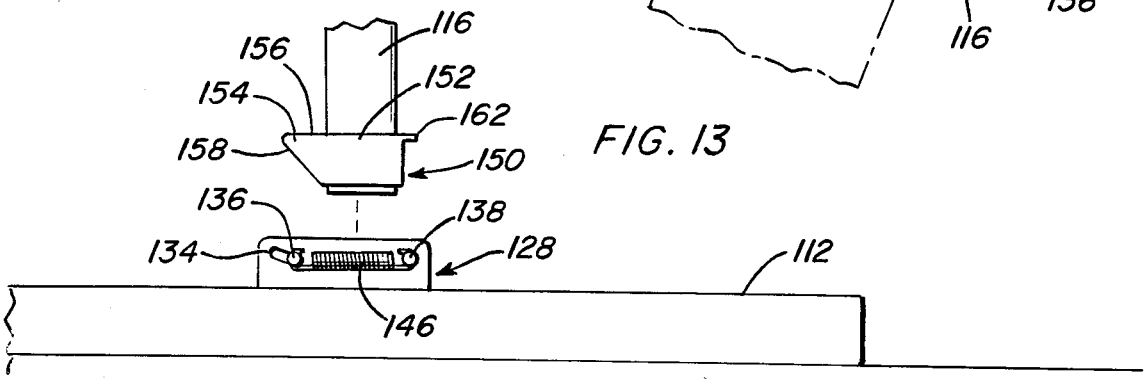
FIG. 13 is a fragmental elevational view with the stand in elevated position illustrating the releasable engagement of the connection between the stand and leg.

The upper end of the tubular leg member 116 is provided with a bracket 150 which includes a pair of substantially parallel side plates or flanges 152 having projecting or extending end portions or tabs 154 provided with substantially straight lower edges 156 and an upwardly and inwardly inclined upper cam edge 158 with the extending tabs 154 being continuations of the side plates 152 and associated with the rod 136 and slots 134 in the same manner as in the embodiment illustrated in FIGS. 1–7. The inner ends of the side plates or flanges 152 are interconnected by a plate or flange 160 which is also a continuation of and unitary with the side plates or flanges 152 and oriented in perpendicular relation thereto. The lower edge of the inner plate or flange 160 is provided with a laterally extending lip or flange 162 integral therewith with the lip or flange 162 being positioned in overlying engaging relation to the transverse rod 138 that is rigid with the lugs 132 on the bracket 128. The tubular leg member 116 is rigidly affixed to the bracket 150 with the inner plate or flange 160 being disposed against the tubular leg member 116 so that the inner surface of the tubular leg member 116 also engages the inner surface of the stationary rod 138 which may be welded to the lugs 132 or otherwise affixed thereto. The upper end of the tubular leg member 116 is substantially flat or straight and engages the downwardly facing flat surface of the bight portion 130 of the bracket 128 as illustrated in FIG. 12 so that the coaction of the bracket 150 and tubular member 116 with the bracket 128, the stationary locking rod 138 and the spring-biased locking rod 136 is such that an upward bias is exerted by the locking rod 136 against the projecting tabs 154 thus continuously biasing the tubular leg member 116 upwardly into engagement with the bight portion 130 of the bracket 128. When it is desired to separate the legs 114, the stand 110 is inverted as illustrated in FIG. 13 and locking rod 136 is manually retracted towards the outer ends of the slots 134 so that the tubular leg member 116 can then be pivoted inwardly until the rounded tip end of the tabs 154 pass the rod 136 and then the tubular leg member can be moved laterally outwardly to disengage the flange or lip 162 from the stationary rod 138. The legs 114 can then be stored in any suitable manner in underlying relation to the supporting panel or in any other desired position. When reassembling the legs 114 to operative position, the tubular leg member 116 is oriented in an inward angular position and the lip 162 is brought into engagement with the rod 138 while the tubular leg member 116 is in the inwardly disposed angular position. After the lip 162 has been engaged under the rod 138, the tubular leg member 116 may be pivoted toward a vertical position with the cam surfaces 158 engaging the movable lock rod 136 and camming it outwardly against the tension of the springs 146 so that the tip end of the projecting tabs 154 will pass the rod 136 and the tension of the springs 146 will snap the lock rod 136 inwardly into engagement with the edges 156 of the tabs 154 thereby securely and stably locking the legs 114 in operative position.

As indicated previously, the stand 10 may assume various configurations, sizes and shapes with the supporting panel 12 provided with a planar upper surface, depending peripheral flange or any other specific structure including frame structures for supporting an item or items in an elevated relation to a supporting floor or other surface. Also, a single leg assembly or multiple leg assemblies may be provided depending upon the shape and configuration of the stand. In both embodiments of the invention, the cooperating brackets and spring-biased snap lock rod provides a rigid and stable connection with the lock rod and extending tabs providing a latch structure at one edge of the brackets and the hinge bolt and stationary rod and lip forming a connecting means at the opposite or inner edge of the cooperating brackets with the bracket attached to the stand defining generally a downwardly opening socket and the spring-biased locking rod biasing the leg structure so that the upper end is in intimate and secure surface-to-surface engagement with the flat undersurface of the bracket on the stand. In both embodiments, the snap lock rod or latch structure is easily manipulated to enable the legs to move to inoperative or collapsed position either by pivoting or separation and the cam structure formed by the extending tabs enables the legs to be quickly and securely moved to operative position in the manner previously set forth specifically in connection with each embodiment of the invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A supporting structure comprising a support panel, at least one support leg assembly, and means connecting said leg assembly to said panel in perpendicular depending relation thereto to support the support panel in elevated relation to a support surface, said connecting means including a bracket fixedly attached to said support panel, said bracket including a downwardly opening socket, said leg assembly including an upper end received in said socket and including a latch structure at one edge portion thereof and means at the opposite edge portion engaged with said bracket, said bracket including a spring-biased member slidably mounted thereon for permitting the latch structure to pass upwardly into the socket by outward movement of the spring-biased member, said spring-biased member snapping back into underlying relation to the latch structure to retain the leg assembly in perpendicular relation to the support panel, said latch structure including an inclined cam surface on the upper end thereof for camming said spring-biased member outwardly when the latch structure moves into the socket, said bracket including spaced parallel plates forming a portion of the socket, each of said plates including an upwardly and inwardly inclined slot, said spring-biased member including a rod having end portions slidable in the slots, and tension coil springs interconnecting the rod and plates to bias the rod inwardly in the slots to continuously bias the latch structure upwardly in relation to the socket.

2. The structure defined in claim 1 wherein said bracket has a substantially planar internal surface defining the upper end of the socket, the upper end of the leg assembly including a substantially flat upper end for engaging the upper end of the socket for securely retaining the leg assembly in perpendicular relation to the support panel.

3. The structure defined in claim 2 wherein said means at the edge opposite the latch structure engaging the bracket includes a pivot assembly pivotally connecting the leg assembly to the bracket for pivotal movement between a generally horizontal folded position and a generally vertical operative position.

4. The structure defined in claim 2 wherein said means at the edge opposite the latch structure engaging the bracket includes a lateral projection on the leg assembly and a transverse projection on the bracket with the projection on the leg assembly being insertable into overlying relation to the projection on the bracket when the leg assembly is in angular relation to the support panel and then swung to a perpendicular relation thereto and locked in position thereby enabling the leg assembly to be detachable from and attached to the support panel.

5. The structure as defined in claim 4 wherein said transverse projection on the bracket is in the form of a transverse rod interconnecting the plates forming the bracket in a rigid manner generally parallel to the slidable rod, said tension coil springs interconnecting the ends of the transverse rod and slidable rod outwardly of the plates forming the bracket, said transverse rod being spaced below the upper end of the socket and said lateral projection on the leg assembly being spaced below the upper end of the leg assembly to enable the projection on the leg assembly to be inserted into overlying contact with the transverse rod when the leg assembly is oriented in inward angular relation to the support panel with the inclined cam surface on the latch structure biasing the slidable rod outwardly as the leg assembly is swung to perpendicular relation to the support panel with the slidable rod passing over the end of the cam surface and engaging substantially straight edges on the latch structure for biasing the latch structure and leg assembly against the upper end of the socket.

6. The structure as defined in claim 3 wherein said latch structure includes a pair of projecting tabs opposite to the pivot assembly with each tab including an inclined cam surface on the upper edge thereof and a substantially straight lower surface engaged with the slidable rod when the leg assembly is in vertical operative position with the inclined structure of the slots causing upward movement of the slidable rod and thus upward bias on the leg assembly to bias the leg assembly into engagement with the upper end of the socket, the central portion of the slidable rod being manually engageable for pulling it outwardly beyond the tip ends of the projections to enable the leg assemblies to pivot inwardly about the pivotal connection with the cam surfaces engaging the rod when the leg is swung back toward vertical position for biasing the rod outwardly in the slots until the tip ends of the tabs pass upwardly beyond the rod at which time the rod snaps inwardly under the straight bottom edges of the tabs for camming the leg assemblies upwardly.

7. A supporting structure comprising a support panel, a pair of support legs assemblies, and means connecting each of said leg assemblies to said panel adjacent opposite edge portions thereof and in perpendicular depending relation thereto to support the support panel in elevated relation to a support surface, each of said connecting means including a bracket fixedly attached to said support panel, said bracket including a downwardly opening socket, each of said leg assemblies having an upper end received in said socket and including a latch structure rigidly mounted at one edge portion thereof and means at the opposite edge portion of the leg assembly engaged with said bracket, said bracket including a spring-biased member slidably mounted thereon for permitting the latch structure to pass upwardly into the socket by outward movement of the spring-biased member, said latch structure including a pair of laterally spaced, generally parallel plates received in the socket, each of said plates having a projecting tab extending remotely from the means at the opposite edge portion of the leg assembly engaged with the bracket, said spring-biased member snappng back into underlying engaging relation to the tabs after the upper end of the leg assembly has moved into the socket and engaging the tabs to retain the leg assembly in perpendicular relation to the support panel with engagement of said member with the tabs providing points of supporting engagement with the leg assembly at laterally spaced points for stable support of the leg assembly.

8. The structure as defined in claim 7 wherein said bracket includes spaced parallel lugs forming a portion of the socket, each of said lugs including an upwardly and inwardly inclined slot, said spring-biased member including a rod having end portions slidable in the slot, and spring means engaging the rod to bias the rod inwardly in the slots to continuously bias the latch structure upwardly at laterally spaced points in relation to the socket for engaging the upper end of the leg assembly with the upper end of the socket.

9. The structure as defined in claim 8 wherein each of said plates includes an inclined cam surface on the upper edge of the projecting tabs for camming said spring-biased rod outwardly to enable the tabs to pass said rod when the upper end of the leg assembly moves into the socket.

10. The structure as defined in claim 9 wherein said means at the opposite edge portion of the leg assembly engaged with said bracket includes a pivot assembly connecting the leg assembly to the bracket intermediate the spaced points of engagement between the rod and the tabs of the latch structure for pivotal movement of the leg assemblies between a generally horizontal folded position and a generally vertical operative position in perpendicular relation to the support panel.

11. The structure as defined in claim 9 wherein said means at the opposite edge portion of the leg assembly engaged with said bracket includes a lateral projection on the leg assembly and a transverse projection on the bracket with the projection on the leg assembly being insertable into overlying relation to the projection on the bracket when the leg assembly is in angular relation to the support panel and then swung to a perpendicular relation thereto and locked in position by the latch structure thereby enabling the leg assembly to be detachable from and attached to the support panel, said projection on the leg assembly and said projection on the bracket extending substantially completely across the width of the leg assembly and socket to cooperate with the spaced points of engagement between the rod and tabs to provide stable support for the leg assemblies.

* * * * *